United States Patent [19]

Rohan et al.

[11] 4,155,077

[45] May 15, 1979

[54] APPARATUS FOR AUDIBLE ALERTING OF ENCLOSURE OPENING

[76] Inventors: Joseph J. Rohan, 841 Amolac, St. Louis County, Mo. 63141; Gregory W. Kuehl, 4079 Calvera, St. Louis County, Mo. 63033

[21] Appl. No.: 785,309

[22] Filed: Apr. 6, 1977

[51] Int. Cl.[2] ..... G08B 13/18; G08B 13/08

[52] U.S. Cl. ..... 340/546; 340/600

[58] Field of Search ..... 340/283, 275, 281, 274 R, 340/421, 309.1, 384 E; 307/208, 214

[56] References Cited

U.S. PATENT DOCUMENTS

| | | | |
|---|---|---|---|
| 3,797,006 | 3/1974 | Reininger | 340/274 R |
| 3,909,819 | 9/1975 | Radford | 340/281 |
| 3,930,249 | 12/1975 | Steck et al. | 340/283 |
| 3,995,268 | 11/1976 | Ferrari | 340/384 E |
| 4,030,087 | 6/1977 | Ritchie et al. | 340/261 |

*Primary Examiner*—Glen R. Swann, III

*Attorney, Agent, or Firm*—Kalish & Gilster

[57] ABSTRACT

A portable, miniaturized, self-contained audible alerting device is disclosed. The device is housed in a small case adapted to be positioned in a darkened enclosure, such as a medicine cabinet, for receiving light when the enclosure is opened, producing an audible signal after a predetermined time delay for alerting a person some distance from the enclosure that the latter has been opened, e.g., by a child. Within the case is a photodetector positioned with respect to an aperture of the case which receives light upon opening of the enclosure. Also within the case is a time delay circuit responsive to the photodetector, an amplifier circuit and audible signalling circuitry, including a transducer, for providing the audible alerting signal only after the time delay. The time delay prevents the alerting signal from being given if the enclosure is opened and then closed quickly enough by a person knowing of the device, e.g., the parent of the child.

6 Claims, 4 Drawing Figures

APPARATUS FOR AUDIBLE ALERTING OF ENCLOSURE OPENING

BACKGROUND OF THE INVENTION

The invention relates to devices for audibly signalling or alerting in response to light and, more particularly, to self-contained, portable devices of such character which are responsive to receiving light upon the occurrence of an event to be detected.

Within a typical household where there are young children, a medicine cabinet and other normally darkened enclosures having easily opened doors are typically used for storage of medicines, drugs and other poisonous or potentially dangerous substances or items.

It is often desirable for a parent or other person responsible for such a child in this kind of an environment to know if the child should open an enclosure containing a substance or other item which could be injurious to the child.

However, it is often difficult, if not impossible, to closely monitor the activities of a normally inquisitive child within the home. Accordingly, to prevent a child from opening an unlocked enclosure containing potentially injurious substances or items is not practically attainable.

Of course, it would be possible to install burglar alarm-type sensors, such as door-operated switches wired to an alarm, but this is usually prohibitively complex and expensive.

SUMMARY OF THE INVENTION

It is an object of the present invention to provide an audible alerting apparatus constituting a device which can be placed in a normally darkened enclosure and useful for audibly alerting a person some distance from the enclosure when the enclosure is opened.

It is a further object of the present invention to provide a device of the foregoing character which provides such audible alerting only after a predetermined time delay period following opening of the enclosure.

Another object of the invention is to provide a device of the foregoing character which is portable, miniaturized, self-contained and which also is extremely simple to use, is of relatively simple construction, and is reliable and long-lasting in use.

Other objects and features will be apparent or are pointed out in the description which follows.

BRIEF DESCRIPTION OF THE DRAWINGS

Corresponding reference characters indicate corresponding elements in the several figures of the drawings.

DESCRIPTION OF THE PREFERRED EMBODIMENTS

Figure 1:
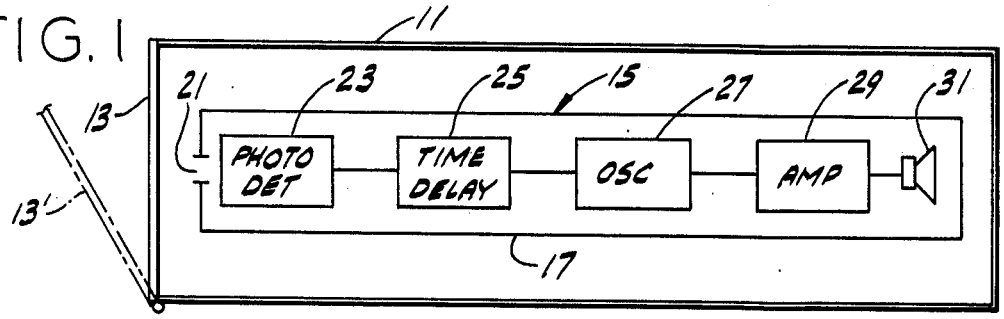
FIG. 1 is a simplified block diagram of a first embodiment of the invention.

Referring to FIG. 1, designated 11 is an enclosure of such as a medicine cabinet, which is normally darkened when a door 13 or other usual closure is in the closed position shown. When the door is opened as shown at 13', light is permitted to enter enclosure 11.

It will be understood, of course, that enclosure may be of virtually any size, shape and configuration so long as it is of sufficient volume to house an audible alerting apparatus, i.e., the device of the present invention. As shown in FIG. 1, within enclosure 11 has been placed a device of the present invention. The device is designated generally at 15. Device 15 includes a small case 17, e.g., of plastic or metal, suitably shaped for enclosing all of the circuit elements of the device and a battery for powering such circuitry, all as later described.

Figure 2:
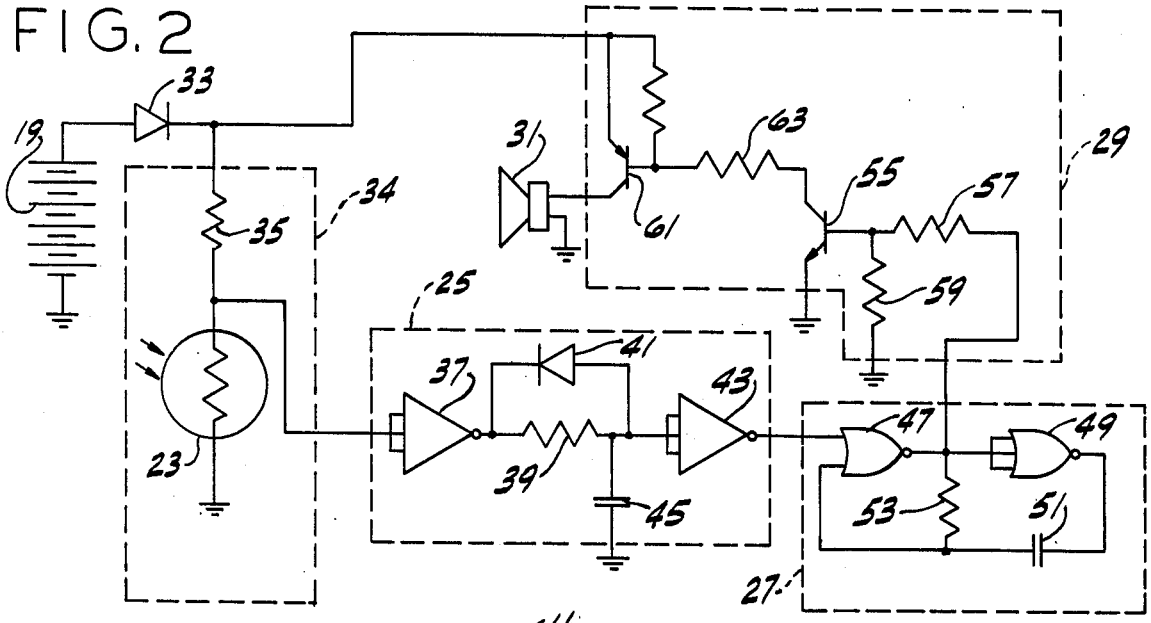
FIG. 2 is a schematic circuit diagram of the embodiment of FIG. 1.

The battery, e.g., a 9-volt transistor radio type, is designated at 19 in FIG. 2, but is not shown in FIG. 1 in the interest of simplicity. Other elements of the embodiment of device 15 are shown in FIG. 1 in block form however.

At 21 is shown an aperture of case 17. While the aperture may be simply an opening in the case, it may also comprise a lens in the sense that a lens may be said to have an aperture, or may simply be some area on the surface of case 17 for receiving light from outside enclosure 11 when the latter is opened. In any event, a photodetector 23 is positioned within case 17 with respect to aperture 21 for detecting light received by the aperture. The photodetector provides a first signal in response to the detected light to a time delay circuit 25 within the case.

Time delay circuit 25 provides a time-delayed second signal in response to the first signal after a predetermined period following the providing of the first signal. This second signal is supplied to an oscillator circuit 27 within the case for providing an oscillating signal in response to the time-delayed second signal. This oscillating signal is amplified by an amplifying circuit 29 within the case and, as sufficiently amplified, is delivered to a transducer 31, such as a small loudspeaker in the case to provide an audible alerting signal which will be audible to a person outside enclosure 11 and well removed or distant therefrom, e.g., in another room.

As illustrated, device 15 is positioned within enclosure 11 for permitting light from outside the enclosure to be received by aperture 21 when the enclosure is opened by movement of the door 13 to the open position 13'. Accordingly, if the enclosure is a medicine cabinet, for example, which is opened by a small child, a parent will be alerted after the predetermined time delay period by the audible signal.

FIG. 2 shows the overall circuitry of the FIG. 1 embodiment. Battery 19 supplies a suitable potential through a diode 33 to a circuit 34 including photocell 23. Hence, a current flows through a resistor 35 to photocell 23, here shown as being of a photosensitive type. As will be understood, the resistance of the photocell changes in response to light detected by the cell, thereby producing a change in voltage across the cell constituting said first signal.

Time delay circuit 25 comprises a first logic inverting gate 37 having its input terminals connected to the high side of photocell 23. A resistor 39 (e.g., of 1 megohm) and diode 41 in parallel therewith interconnect the output of gate 37 with the inputs of a second such gate 43. A capacitor 45 (e.g., of 10 microfarad) is connected between the inputs of gate 43 and ground so that with resistor 39 there is provided a resistive-capacitive circuit providing at the output of gate 43 a time-delayed response to the first signal. Both gates 39 and 43 may be part of a commercially available integrated circuit such as type CD4001.

Oscillator circuit 27 comprises a 2-input logic NOR gate 47. One of its inputs receives the time-delay second signal. Its output is interconnected with the inputs of another logic NOR gate 49. The output of the latter is interconnected by a capacitor 51 (e.g., of 0.1 microfarad) to the other input of NOR gate 47. There is a resistor 53 (e.g., of 27 kilo ohms) between the output of the first gate 47 and the latter input thereof. Accordingly, the output of gate 47 supplies an oscillating signal at a suitable audio frequency (e.g., several hundred hertz) to the amplifier circuit 29.

Like the logic gates of time delay circuit 25, the NOR gates of oscillator circuit 27 may be in the form of a conventional commercially available integrated circuit type like the type CD4001.

Amplifier circuit 29 comprises a NPN transistor 55 such as type 2N3415 whose base receives the oscillatory signal via a voltage divider pair of resistors 57 and 59. Its collector drives the base of a PNP transistor 61, such as type D29E6, through a resistor 63 to provide an amplified audio signal from the collector of transistor 61 to loudspeaker 31 which is, of course, responsive to the amplified oscillating signal.

Figure 4:
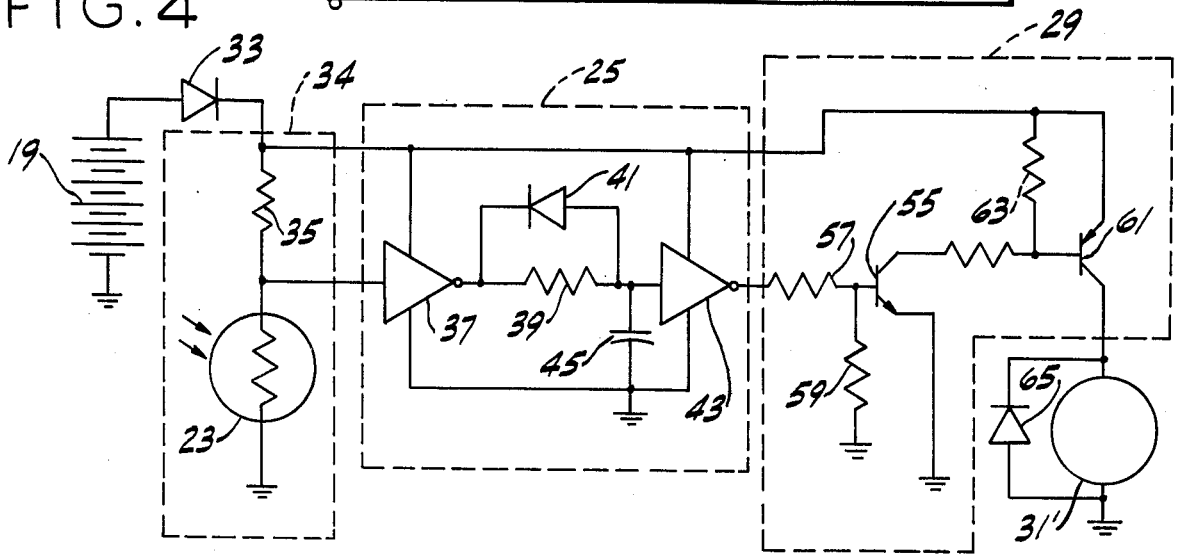
FIG. 4 is a schematic circuit diagram of the embodiment of FIG. 3.

The various usual power leads which supply voltage from battery 19 to gates 37, 43, 47 and 49 are not shown in the interest of simplifying FIG. 2. Representative power connections are, however, shown in the circuit of FIG. 4.

Figure 3:
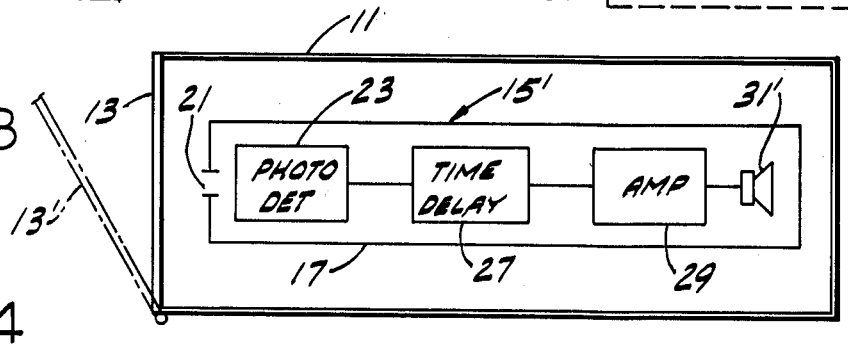
FIG. 3 is a simplified block diagram of a second embodiment of the invention.

A simpler embodiment of the invention is shown in block form in FIG. 3 and is designated generally 15'. It has a similar or identical case 17 having elements 23, 25, 29 and a transducer 31' of the type responsive to a d.c. signal of sufficiently amplified magnitude. For example, it may be a buzzer-type transducer such as the commercially available type sold under the trademark "SONALERT". A diode 65 may be connected across such buzzer-type transducer 31' to protect transistor 61 from high reverse voltage peaks produced by the inductance of the transducer.

When integrated circuit devices of the type noted above are employed for the present device, it is practical for the case dimensions to be of very small rectangular size, e.g., with its greatest dimension not more than a couple of inches or so, with a thickness of an inch or so. Accordingly, the device is quite portable and miniaturized and, hence, may readily be placed in a medicine cabinet or other enclosure and even may be concealed easily.

The time delay feature permits a knowledgeable person, such as a parent, to quickly open the medicine cabinet and retrieve a familiar item and then close the door promptly without causing an audible signal to be given. However, a curious child is not so quickly purposeful in opening and then promptly closing the door to prevent a signal from being given.

The photocell used in the device is preferably responsive to a visible portion of the spectrum, such as about 500 nanometer, so that it will be responsive to the usually present sources of light such as sunlight, as well as fluorescent and incandescent sources.

The specific embodiments shown and described herein are intended to be illustrative and not restrictive of the scope of the invention, it being understood that the claims are intended to encompass all variations within the range of equivalence.

Having described our invention, what we claim and desire to obtain by Letters Patent is:

1. A portable miniaturized self-contained audible alerting apparatus for being placed in a normally darkened enclosure for audibly alerting a person outside of and a distance from said enclosure that said enclosure is opened, said apparatus comprising a small case having a light-receiving aperture, photodetector means within said case and positioned with respect to said aperture for detecting light received by said aperture and providing a first signal which is electronic and of an inaudible character in response to detected light, time delay means within said case for providing a time-delayed second signal in response to the persistence of said first signal for a predetermined period, said time delay means including a first logic inverting gate having an input interconnected with said photodetector means, a resistor interconnecting the output of the first logic inverting gate to at least one input of a second logic inverting gate, and a capacitor interconnected with said input of the second logic gate and adapted for being charged through said resistor, the output of the secnd logic inverting gate providing said time-delayed second signal, amplifier means within said case for effectively amplifying said time-delayed second signal, and audible signaling means within said case and responsive to the amplified second signal for providing an audible alerting signal of sufficient loudness for being heard by said person outside of and at a distance from said enclosure, said case including within it a battery for powering said time delay means, said amplifier means, and said audible signaling means, said case being positionable within said enclosure for permitting light outside said enclosure to be received by said aperture when said enclosure is opened whereby if said enclosure is opened, said person will be alerted after said predetermined period by said audible alerting signal, said time delay means being operative for preventing said alerting signal from being given if said enclosure is not opened for the predetermined period, said first signal being terminated when light is no longer detected by said photodetector means, said audible alerting signal ceasing after light is no longer detected by said photodetector means.

2. Apparatus as set forth in claim 1 wherein said audible signalling means comprises a transducer of a type responsive to a d.c. signal of sufficiently amplified magnitude.

3. Apparatus as set forth in claim 2 wherein said audible signalling means comprises a transducer of a type responsive to an oscillating signal, said apparatus further comprising oscillator means for providing an oscillating signal to said transducer in response to said time-delayed second signal.

4. Apparatus as set forth in claim 3 wherein oscillator means is connected between said time delay means and said amplifier means.

5. Apparatus as set forth in claim 4 wherein said oscillator means comprises a first and second logic NOR gates, the first logic NOR gate receiving said time-delayed second signal as one input thereof, the output of the first NOR gate being interconnected with the inputs of the second NOR gate, the output of the second NOR gate being interconnected by a capacitor with another input of the first NOR gate, there being a resistor between said output of the first NOR gate and said another input of the first NOR gate, the output of the first NOR gate providing an oscillating signal to said amplifier means.

6. Apparatus as set forth in claim 1 wherein said photodetector means comprises a photosensitive cell connected for being supplied with a current from said battery, the resistance of said cell changing in response to light detected thereby for producing a change in voltage across said cell constituting said first signal.

* * * * *